US011130143B2

(12) United States Patent
Fore

(10) Patent No.: US 11,130,143 B2
(45) Date of Patent: Sep. 28, 2021

(54) SYSTEM AND METHOD FOR DISPENSING DIFFERENT SPRAYS

(71) Applicant: Precision Valve Corporation, Greenville, SC (US)

(72) Inventor: John B. Fore, Travelers Rest, SC (US)

(73) Assignee: PRECISION VALVE CORPORATION, Greenville, SC (US)

( * ) Notice: Subject to any disclaimer, the term of this patent is extended or adjusted under 35 U.S.C. 154(b) by 0 days.

(21) Appl. No.: 15/922,213

(22) Filed: Mar. 15, 2018

(65) Prior Publication Data

US 2018/0200738 A1 Jul. 19, 2018

Related U.S. Application Data

(63) Continuation-in-part of application No. 15/265,988, filed on Sep. 15, 2016.

(51) Int. Cl.

| | |
|---|---|
| ***B05B 1/30*** | (2006.01) |
| ***B65D 83/46*** | (2006.01) |
| ***B65D 83/22*** | (2006.01) |
| ***B65D 83/20*** | (2006.01) |
| ***B65D 83/48*** | (2006.01) |
| *B05B 11/00* | (2006.01) |

(52) U.S. Cl.

CPC ..... *B05B 1/3013* (2013.01); *B05B 1/30* (2013.01); *B65D 83/205* (2013.01); *B65D 83/206* (2013.01); *B65D 83/22* (2013.01); *B65D 83/46* (2013.01); *B65D 83/48* (2013.01); *B05B 11/3005* (2013.01)

(58) Field of Classification Search

CPC ..... B05B 1/3013; B05B 1/30; B05B 11/3005

USPC ..... 239/1

See application file for complete search history.

(56) References Cited

U.S. PATENT DOCUMENTS

| | | | |
|---|---|---|---|
| 2,598,308 | A | 5/1952 | Samuels |
| 2,887,273 | A | 5/1959 | Anderson |
| 3,191,816 | A | 6/1965 | Fead |
| 3,191,817 | A | 6/1965 | Furutani |
| 3,195,569 | A | 7/1965 | Seaquist |
| 3,206,082 | A | 9/1965 | Green |
| 3,209,960 | A | 10/1965 | Green |
| 3,292,827 | A | 12/1966 | Frangos |
| 3,344,961 | A | 10/1967 | Graham |

(Continued)

FOREIGN PATENT DOCUMENTS

| | | |
|---|---|---|
| CN | 102971231 | 3/2013 |
| EP | 1024094 A1 | 8/2000 |

(Continued)

OTHER PUBLICATIONS

Korean Office Action dated Jan. 3, 2019 in corresponding Korean Patent Application No. 10-2017-0111903, 16 pages.

(Continued)

*Primary Examiner* — Chee-Chong Lee

(74) *Attorney, Agent, or Firm* — Ohlandt, Greeley, Ruggiero & Perle, L.L.P.

(57) ABSTRACT

A system and method to spray fluid from a container at different mass flow rates is provided. The system includes an actuator rotatable to select a mass flow rate and a valve having dual orifices that are selectively unsealed when the actuator is depressed according to the mass flow rate selection to effect dispensing of fluid.

8 Claims, 13 Drawing Sheets

(56) References Cited

U.S. PATENT DOCUMENTS

| | | | | |
|---|---|---|---|---|
| 3,363,968 | A | 1/1968 | Williams | |
| 3,424,353 | A * | 1/1969 | Meador | B65D 83/44 222/402.1 |
| 3,653,558 | A | 4/1972 | Shay | |
| 3,711,030 | A | 1/1973 | Jones | |
| 3,795,350 | A | 3/1974 | Shay | |
| 3,795,366 | A | 3/1974 | McGhie et al. | |
| 3,863,816 | A | 2/1975 | Focht | |
| 4,139,128 | A | 2/1979 | Ewald | |
| 4,416,398 | A | 11/1983 | Knickerbocker | |
| 5,379,924 | A * | 1/1995 | Taylor | B65D 83/205 222/402.11 |
| 5,388,730 | A * | 2/1995 | Abbott | B65D 83/205 222/153.13 |
| 5,503,303 | A * | 4/1996 | LaWare | B65D 83/205 222/153.12 |
| 5,531,359 | A * | 7/1996 | Winner | B65D 83/384 222/153.11 |
| 5,901,907 | A | 5/1999 | Hildebrandt | |
| 5,971,230 | A * | 10/1999 | Tanaka | B65D 83/205 222/402.1 |
| 6,039,306 | A | 3/2000 | Pericard et al. | |
| 6,129,247 | A | 10/2000 | Thomas et al. | |
| 6,296,155 | B1 | 10/2001 | Smith | |
| 7,017,785 | B2 | 3/2006 | Lasserre et al. | |
| 7,036,691 | B2 | 5/2006 | Nicolas | |
| 7,104,424 | B2 | 9/2006 | Kolanus | |
| 7,104,427 | B2 | 9/2006 | Pericard et al. | |
| 7,364,055 | B2 | 4/2008 | Yquel et al. | |
| 7,487,891 | B2 | 2/2009 | Yerby et al. | |
| 7,651,003 | B2 | 1/2010 | Albers et al. | |
| 7,699,190 | B2 | 4/2010 | Hygema | |
| 7,757,905 | B2 | 7/2010 | Strand et al. | |
| 7,967,224 | B2 | 6/2011 | Belau et al. | |
| 7,984,827 | B2 | 7/2011 | Hygema | |
| 8,100,298 | B2 | 1/2012 | Marquardt et al. | |
| 8,127,968 | B2 | 3/2012 | Yerby et al. | |
| 8,286,830 | B2 | 10/2012 | Hygema | |
| 8,333,304 | B1 | 12/2012 | Haage | |
| 8,344,056 | B1 | 1/2013 | Tait et al. | |
| 8,418,892 | B2 | 4/2013 | Geier | |
| 8,517,227 | B2 | 8/2013 | Strand et al. | |
| 8,883,902 | B2 | 11/2014 | Tait et al. | |
| 9,205,973 | B2 | 12/2015 | Decea et al. | |
| 9,216,852 | B2 | 12/2015 | Cho et al. | |
| 9,260,237 | B2 | 2/2016 | Brace et al. | |
| 9,359,116 | B2 | 6/2016 | Beranger et al. | |
| 9,505,546 | B2 | 11/2016 | Arora et al. | |
| 9,511,926 | B2 | 12/2016 | Arora et al. | |
| 9,714,131 | B2 | 7/2017 | Arora et al. | |
| 9,758,295 | B2 | 9/2017 | Smith | |
| 2003/0071080 | A1 | 4/2003 | Yquel | |
| 2004/0124217 | A1 | 7/2004 | Yquel et al. | |
| 2006/0201970 | A1 | 9/2006 | Jasek | |
| 2008/0164285 | A1 | 7/2008 | Hygema | |
| 2011/0259923 | A1 | 10/2011 | Chan et al. | |
| 2014/0138409 | A1 | 5/2014 | Beranger et al. | |
| 2014/0291353 | A1 | 10/2014 | Betts et al. | |
| 2015/0313662 | A1 | 11/2015 | Ottanelli | |
| 2016/0377231 | A1 | 12/2016 | Smith | |
| 2017/0233171 | A1 | 8/2017 | Christianson et al. | |

FOREIGN PATENT DOCUMENTS

| | | | |
|---|---|---|---|
| JP | 7-251883 | | 10/1995 |
| JP | 2014532599 | | 12/2014 |
| WO | 2009025697 | A1 | 2/2009 |
| WO | 2011138186 | | 11/2011 |
| WO | 2014080116 | A1 | 5/2014 |
| WO | WO2016170169 | A1 | 10/2016 |
| WO | WO2017067835 | A1 | 4/2017 |

OTHER PUBLICATIONS

Japanese Office Action dated Jan. 22, 2019 in corresponding Japanese Patent Application No. 2017-175760, 8 pages.

Extended European Search Report dated Feb. 8, 2018 from corresponding European Patent Application No. 17184816.1, 10 pages.

Taiwanese Office Action dated Dec. 28, 2018 in corresponding Taiwan Patent Application No. 106128778, 16 pages.

First Chinese Office Action dated May 19, 2020 from corresponding Chinese Patent Application No. 201710786125.5, 14 pages.

Chinese Office Action date Nov. 11, 2020 in corresponding Chinese Patent Application No. 201710786125.5, 18 pgs.

* cited by examiner

SYSTEM AND METHOD FOR DISPENSING DIFFERENT SPRAYS

CROSS REFERENCE TO RELATED APPLICATIONS

This application is a continuation-in-part of U.S. application Ser. No. 15/265,988 filed on Sep. 15, 2016, the entire contents of which is incorporated by reference herein.

BACKGROUND OF THE DISCLOSURE

1. Field of the Disclosure

The present disclosure relates generally to a spray system and a method to release a spray of fluid. More particularly, the present disclosure relates to a dispenser having a spray system and a method to generate selectively different spray rates.

2. Description of Related Art

Conventionally, a dispenser has an aerosol valve assembly and an actuator that opens a valve to release a liquid or fluid product from an aerosol container by downwardly depressing the valve to generate a spray that exits the dispenser with a single mass flow rate. The conventional dispenser does not provide a user with the ability to selectively generate, as desired, different sprays, for example different mass flow rates. This is problematic since a user desires to use a single dispenser, however the spray may need to have a greater mass flow rate for some uses and a lesser mass flow rate for other uses of the dispenser.

Accordingly, there is a need for a dispenser having a system or a method that selectively generates different sprays of fluid, as desired by the user.

SUMMARY OF THE DISCLOSURE

The present disclosure provides a system to release spray fluid in different mass flow or spray rates.

The present disclosure also provides such a system that comprises an actuator that can be partially or fully actuated, a stem connected to the actuator, and a gasket covering a first and second orifice of the stem in an unactuated position. Such a system when partially actuated exposes the first orifice to dispense product at a first flow rate, and when fully actuated exposes the first and second orifices to dispense product at a second flow rate that is higher than the first flow rate.

The present disclosure further provides such a system that further comprises a base that supports a rotatable overcap that controls the extent of actuation and thereby selectively controls the flow rate, as desired.

The present disclosure still further provides such a system with a finger pad that can be pressed by a user for activation, after a flow rate selection has been made by rotating the overcap.

The present disclosure yet further provides such a system in which the actuator when rotated from the non-actuating position can move the stem a first distance relative to the gasket, thereby uncovering a second orifice while the first orifice is covered by the gasket to spray fluid with a first mass flow rate. When the actuator is further rotated away from the non-actuating position, the stem can be moved a second distance relative to the gasket, thereby uncovering the first and second orifices to spray fluid with a second mass flow rate that is greater than the first mass flow rate.

The present disclosure still further provides such a system in which the first orifice is positioned above the second orifice, and the diameter of the first orifice is larger than the diameter of the second orifice.

The present disclosure, in addition, provides such a system with a finger projecting downward from the finger pad and the finger cooperates with various interferences structures on the base of the of the actuator to limit the actuator stroke and thus the mass flow rate of the sprayed fluid.

The present disclosure also provides a method to spray fluid from a container in different mass flow rates, which method comprises: rotating the overcap to select a spray rate, depressing a finger pad or button, and displacing the stem relative to the actuator by a first or second distance based on the spray rate selection.

The above and other objects, features, and advantages of the present disclosure will be apparent and understood by those skilled in the art from the following detailed description, drawings, and accompanying claims.

Figure 1:
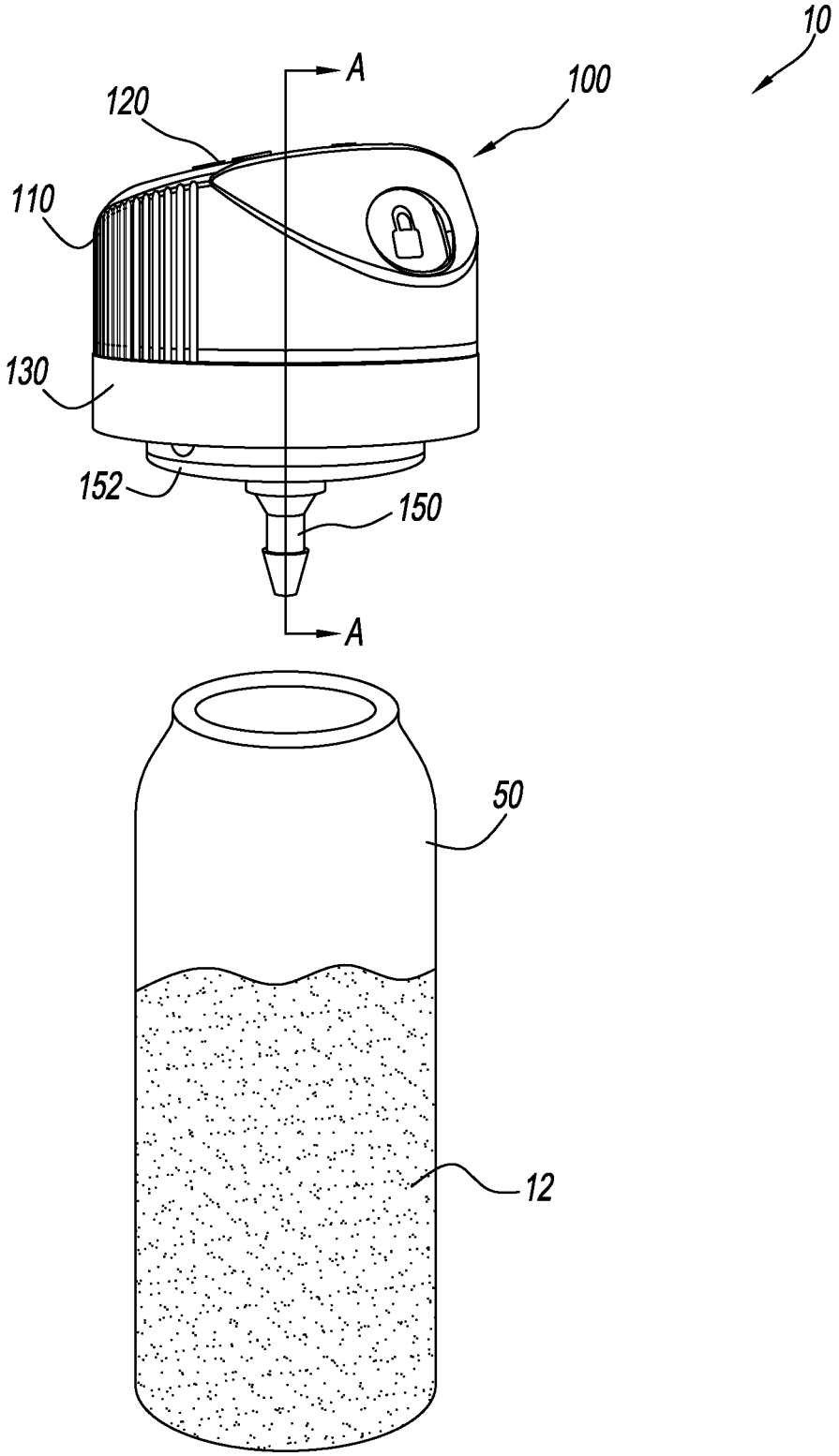
FIG. 1 is a perspective view of the dispensing system for a container according to the present disclosure.

The accompanying drawings illustrate presently preferred embodiments of the present disclosure directed to a spray system and a method to generate selectively different spray rates, and together with the general description given above and the detailed description given below, explain the principles of the present disclosure. As shown throughout the drawings, like reference numerals designate like or corresponding parts.

DETAILED DESCRIPTION OF THE DISCLOSURE

Referring to the drawings and, in particular, to FIG. 1, there is provided a dispensing system according to the present disclosure generally represented by reference numeral 10. Dispensing system 10, hereinafter "system", comprises an actuator 100 that operates a valve 150 to dispense product from a container 50. Container 50 stores product or a fluid 12 that can be dispensed. Fluid 12 in container 50 is pressurized or can be pressurized before and/or after being filled in container 50. Once fluid 12 is pressurized in the container, the pressure acting on fluid 12 in container 50 is higher than an ambient or external pressure.

Valve 150 is a variable spray rate valve. Valve 150 operates in conjunction with actuator 100 to control the spray rate. Actuator 100 has one or more features that allow a full stroke, a partial stroke, or no stroke to control valve 150. Actuator 100 is preferably a two component assembly that is an overcap 110 and a base 130. The one or more features allow a user to select a spray rate for dispensing product, preferably from among two or more spray rates. Overcap 110 rotates on base 130 to select from among position 101 shown in FIGS. 2, 3 and 8, position 103 shown in FIGS. 4 and 5, and position 105 shown in FIGS. 6 and 7. Overcap 110 has a top portion that includes a button 120 that if pressed while in position 103 or position 105 commences dispensing of product. In position 101, however, button 120 is disabled.

Position 101 is an inoperative position or non-actuated position. In position 101, system 10 is locked and dispensing is prevented. Position 101 corresponds to no stroke.

Position 103 is one of at least two operative or actuated positions. In position 103, system 10 dispenses fluid 12 in a mass flow rate less than a nominal mass flow rate of system 10 for the reasons discussed later herein. Position 103 is also referred to as a spray-less position. Position 103 corresponds to a partial stroke.

Position 105 is the second of at least two operative or actuated positions. In position 105, system 10 dispenses fluid 12 in a mass flow rate that is greater than the mass flow rate of position 103 again for the reasons discussed later herein. Position 105 corresponds to a full stroke. Position 105 is also referred to as a spray-more position. Again, fluid 12 is only dispensed in operative or actuated positions, that in the embodiment shown in FIG. 1 are position 103 and position 105.

Figure 2:
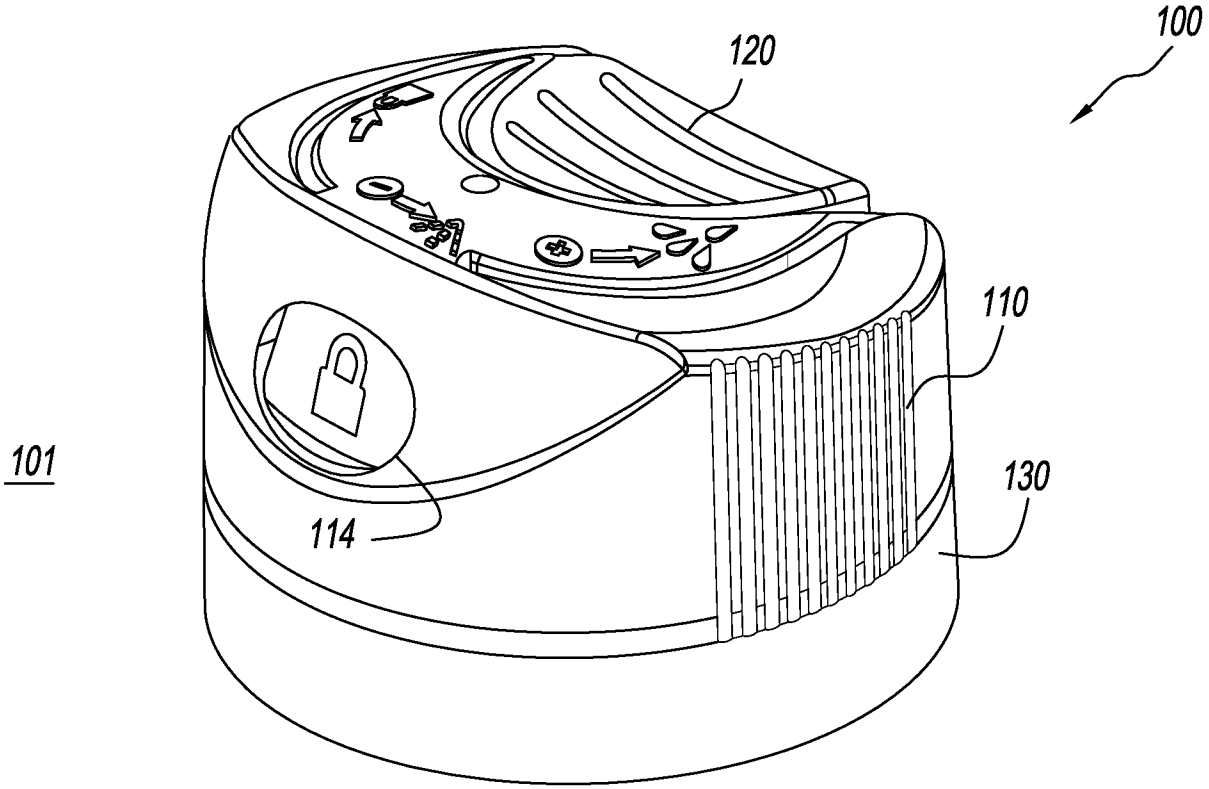
FIG. 2 is a perspective view of an actuator for the dispensing system in a non-actuating position.
Figure 3:
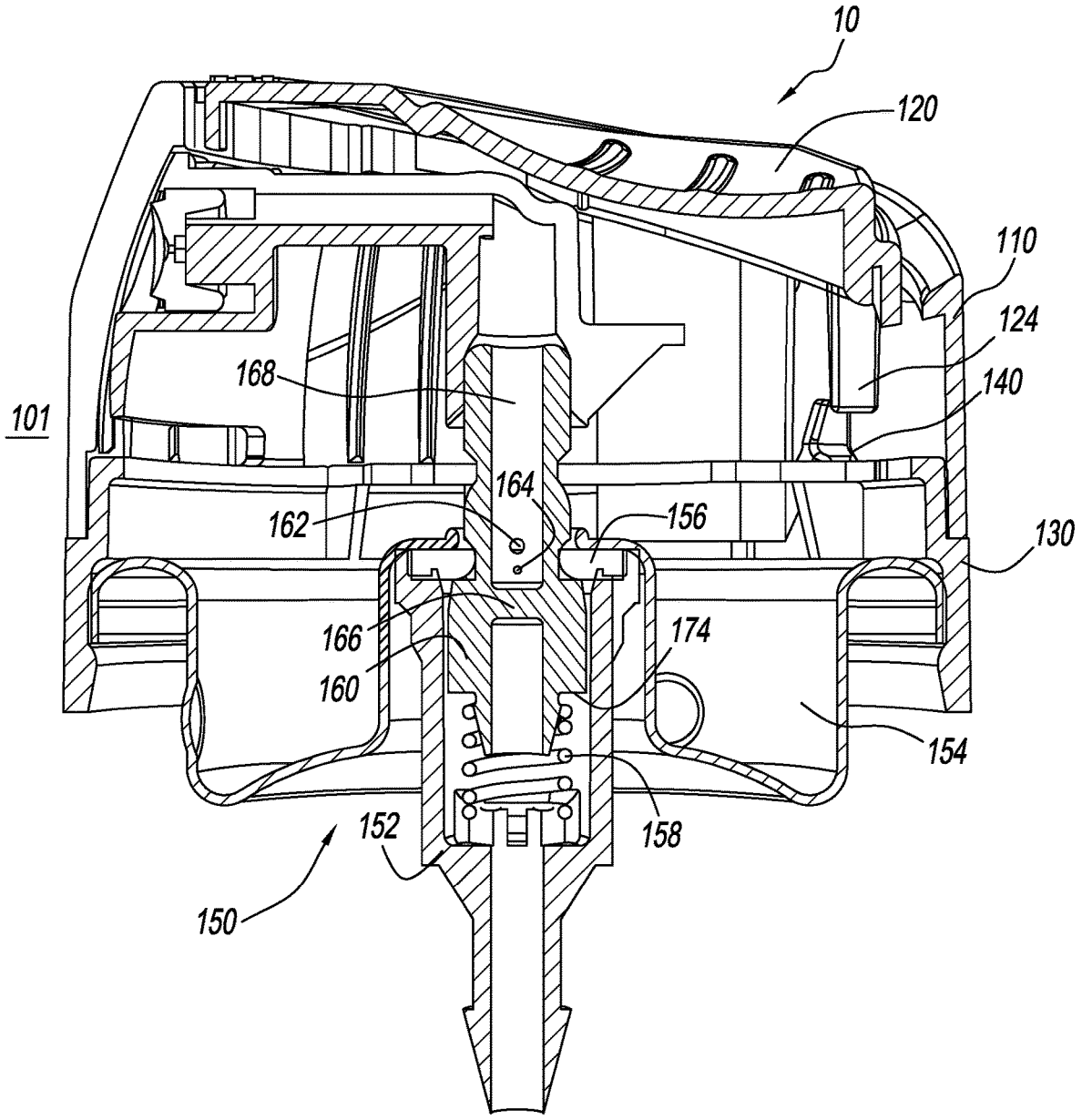
FIG. 3 is cross sectional view taken along lines A-A of the dispensing system of FIG. 1 in the non-actuating position.

Referring to FIGS. 2 and 3, system 10 is shown in position 101. Referring to FIG. 3, valve 150 includes a housing 152, a cup 154, a sealing member 156, a biasing member 158 and a stem 160.

Figure 14:
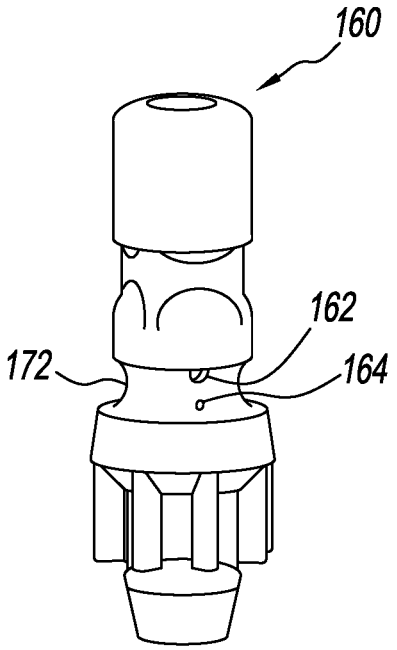
FIG. 14 is a perspective view of an exemplary valve stem of the present dispensing system.
Figure 15:
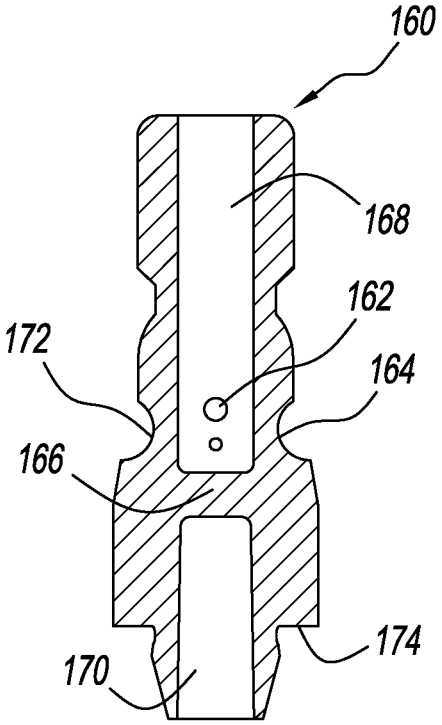
FIG. 15 is a cross sectional view the valve stem of FIG. 14 taken along lines B-B.

Stem 160, shown more clearly in FIGS. 14 and 15, has at least two vertically aligned lateral orifices, namely orifice 162 and orifice 164 that are selectively opened to enable a variable spray rate. Stem 160 is a hollow cylindrical member with an inner partition 166 that divides an upper passage 168 and a lower passage 170. On the outside, stem 160 has an annular groove 172 positioned above partition 166. Groove 172 is shown in the figures as having a concave shape.

Orifice 162 and orifice 164 are radially disposed in groove 172 through a wall of stem 160, and provide fluid communication with upper passage 168. In certain embodiments, orifice 162 and orifice 164 are vertically displaced with respect to each other, and not vertically aligned.

A shoulder surface 174 of stem 160 is located at a lower portion thereof, and provides a surface against which biasing member 158 can engage.

Stem 160 also has a plurality of ribs 176 equally spaced around the stem. Ribs 176 provide flow channels for fluid 12 shown in FIG. 1.

Referring again to FIG. 3, stem 160 is disposed in housing 152 so that an upper portion projects through a central opening in a pedestal portion of cup 154. Cup 154 is crimped to a top of housing 152. Beneath an underside of cup 154 is sealing member 156. Sealing member 156 encircles orifice 162 and orifice 164 and acts to seal the orifices in position 101. Biasing member 158 is disposed in housing 152 between a base of housing 152 and stem 160 so that the stem is displaceable relative to sealing member 156. Thus, stem 160 is vertically displaceable in housing 152 to selectively uncover orifice 162 in position 103, or orifices 162 and 164 in position 105, thus enabling a variable or variation in spray rate. Again, sealing member 156 covers both orifices 162 and 164 in position 101.

Sealing member 156 is preferably an annular gasket made of a flexible material and impermeable to fluid 12. In some embodiments, position 101 can have orifice 164 located partially or completely above sealing member 156.

Biasing member 158 can be a spring, such as a metal coil spring.

Actuator 100 operates valve 150. The elements of actuator 100, namely overcap 110 and base 130, are shown more clearly in FIGS. 9 to 10 and 11 to 13, respectively.

Overcap 110 is an annular ring member with an opening 114 in a sidewall thereof, and a button 120 connected at a trop portion of the sidewall by a hinge 126, preferably a living hinge. A bottom surface 116 is supported on base 130. One or more tabs 118 project downward from overcap 110 for connecting to base 130. Overcap 110 can have one or more surface features, such as ribbed surface 112, to facilitate gripping during rotation.

Button 120 has positioning ribs 122 that project from a bottom surface. Ribs 122 engage nozzle 136 when button 120 is depressed. A finger 124 projects downward from a rear portion of button 120. Finger 124 cooperates with various interferences structures, which will be discussed below, to limit the stroke.

Base 130 has a ring member 132 with an annular ledge or flange 138 for receiving overcap 110. Overcap 110 rotates on flange 138 to select from among a non-actuating position and at least two actuating positions. Base 130 also has a wall 134 with an opening that communicates with a nozzle 136. Nozzle 136 has vertical and horizontal components. The horizontal component communicates with the opening in the wall while the vertical component communicates with upper passage 168. Base 130 also has two slots 146 for receiving two tabs 118 of overcap 110. Optionally, tabs 118 have hooks for being retained in the slots 146. These slots 146 limit rotation of overcap 110 at the extreme in a first direction that is position 101 and the extreme in a second direction that is position 105. When rotated to position 103 or 105, opening 114 exposes nozzle 136.

Figure 8:
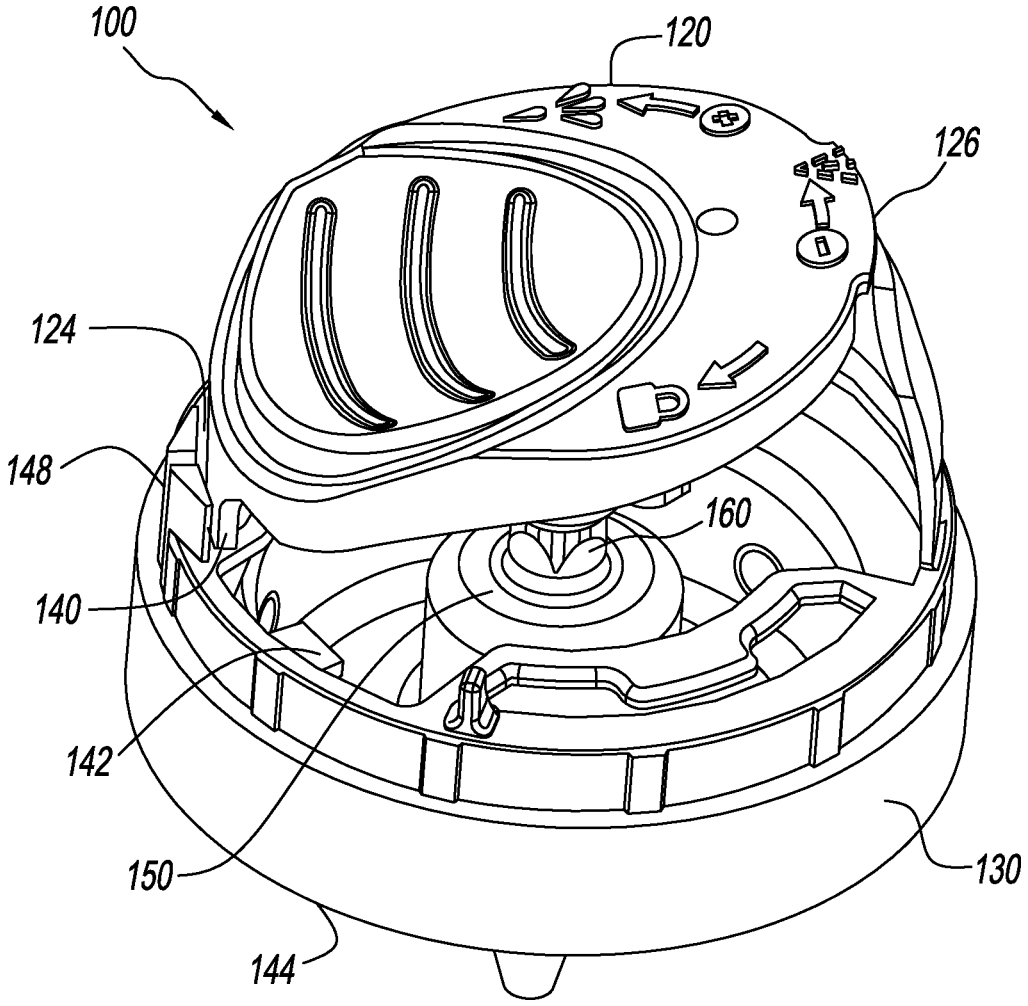
FIG. 8 is partial perspective view of the actuator according to the present disclosure with a portion of the actuator hidden.
Figure 9:
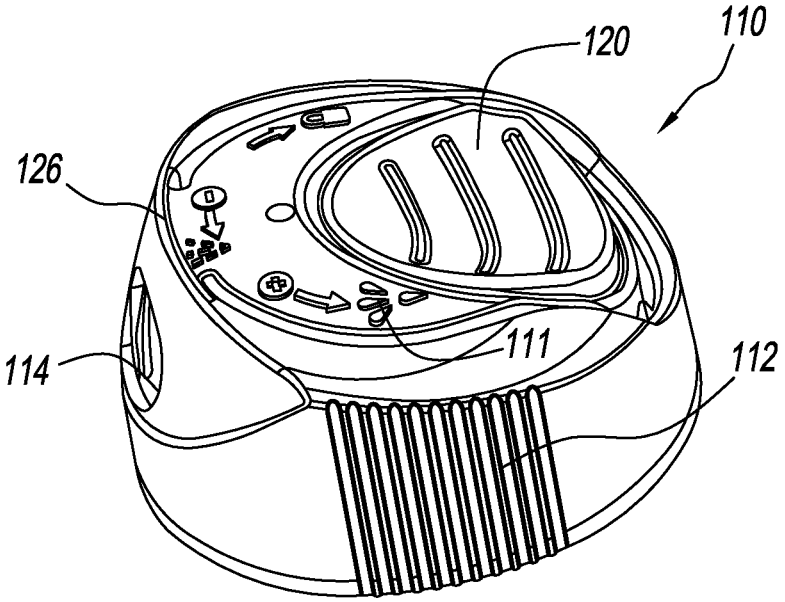
FIG. 9 is a top perspective view of an overcap for the actuator of FIG. 1.
Figure 10:
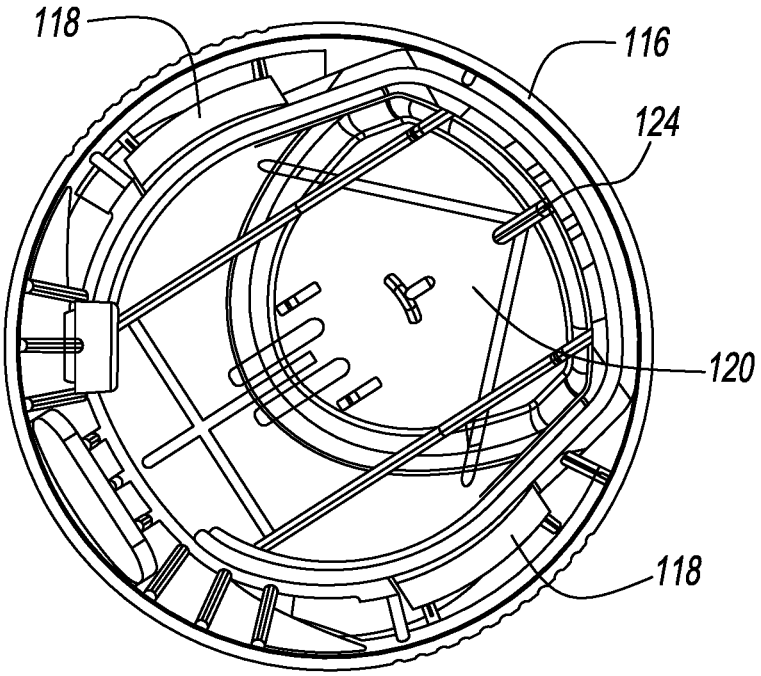
FIG. 10 is a bottom view of the overcap of FIG. 9.
Figure 11:
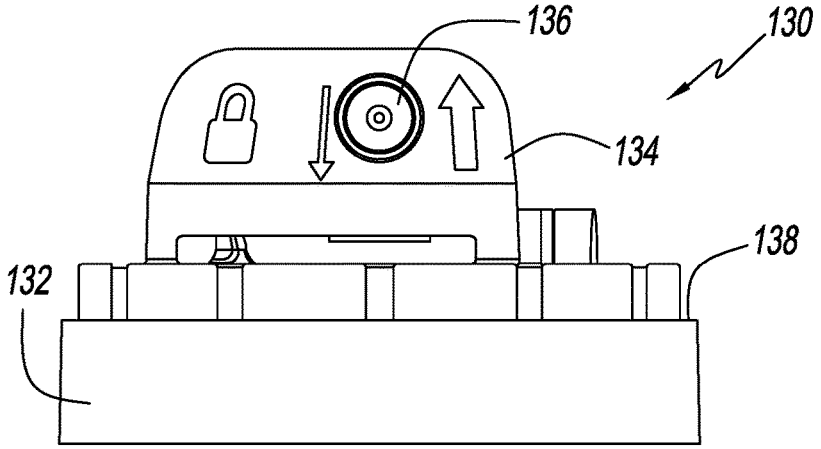
FIG. 11 is a view of a base for the actuator of FIG. 2.
Figure 12:
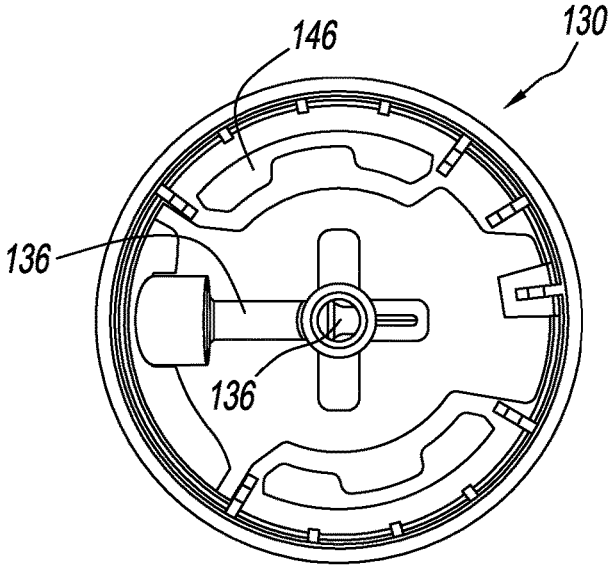
FIG. 12 is a top view of the base of FIG. 11.
Figure 13:
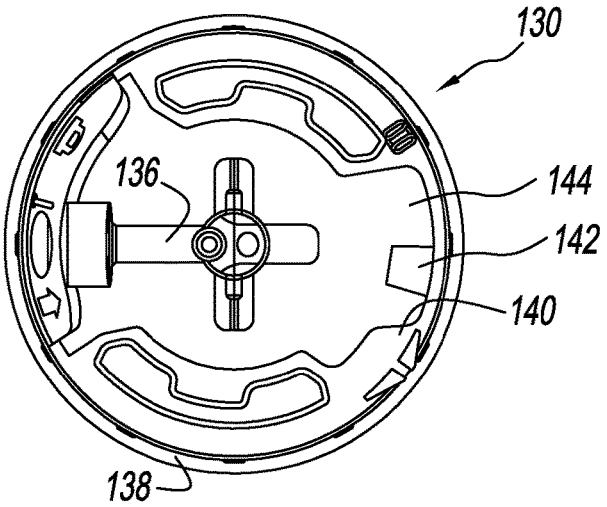
FIG. 13 is a bottom view of the base of FIG. 11.

Referring to FIG. 8, interference structure 140 is a horizontally projecting surface from base 130 that prevents any stroke of actuator 100. Specifically, interference structure 140 engages a finger 124 that is connected to button 120, thereby blocking depression. When rotated, finger 124 is above interference structure 142. Interference structure 142 is a surface lower than interference structure 140 so that a partial stroke is possible, but a full stroke of actuator 100 is prevented. When further rotated, finger 124 is above area 144 where there are no interference structures. Accordingly, a full stroke of actuator 100 can be achieved because there are no structures to interfere with finger 124.

The operation of dispensing system 10 includes the following. Referring again to FIG. 3, overcap 110 is in position 101. As such, button 120 cannot be depressed because interference structure 140 engages finger 124. Sealing member 156 seals both orifice 162 and 164.

Figure 4:
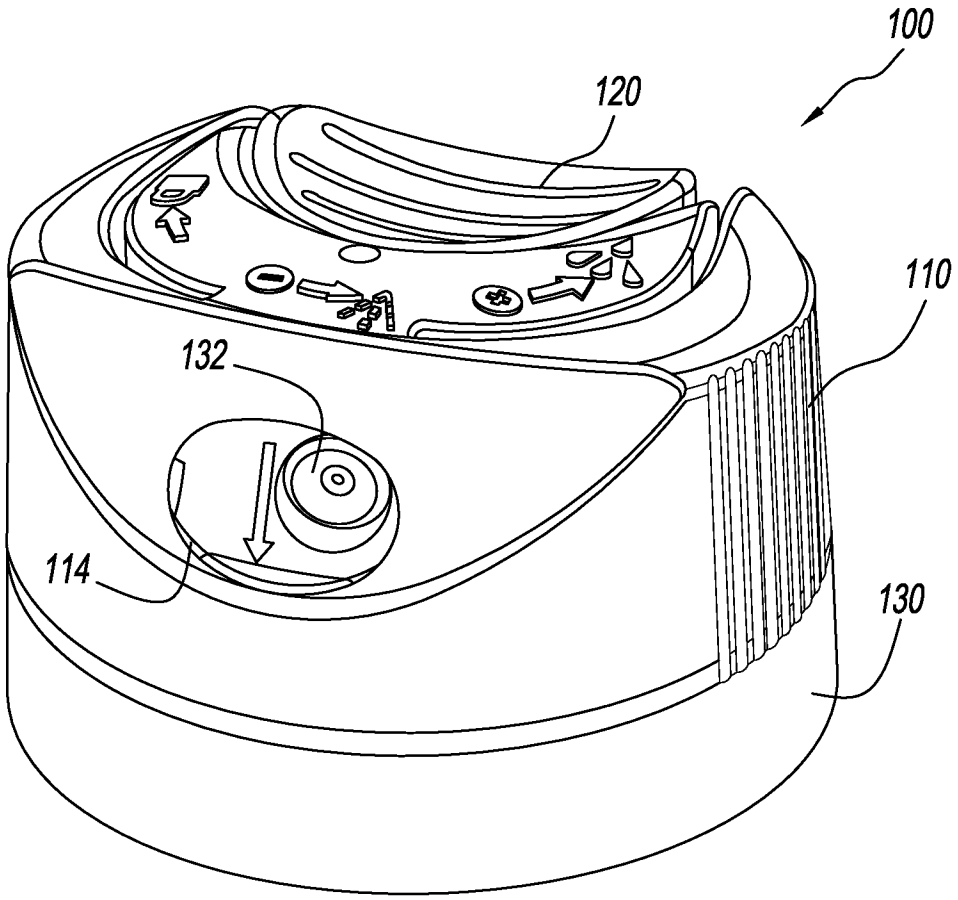
FIG. 4 is a perspective view of the actuator of FIG. 2 in a first actuating position.
Figure 5:
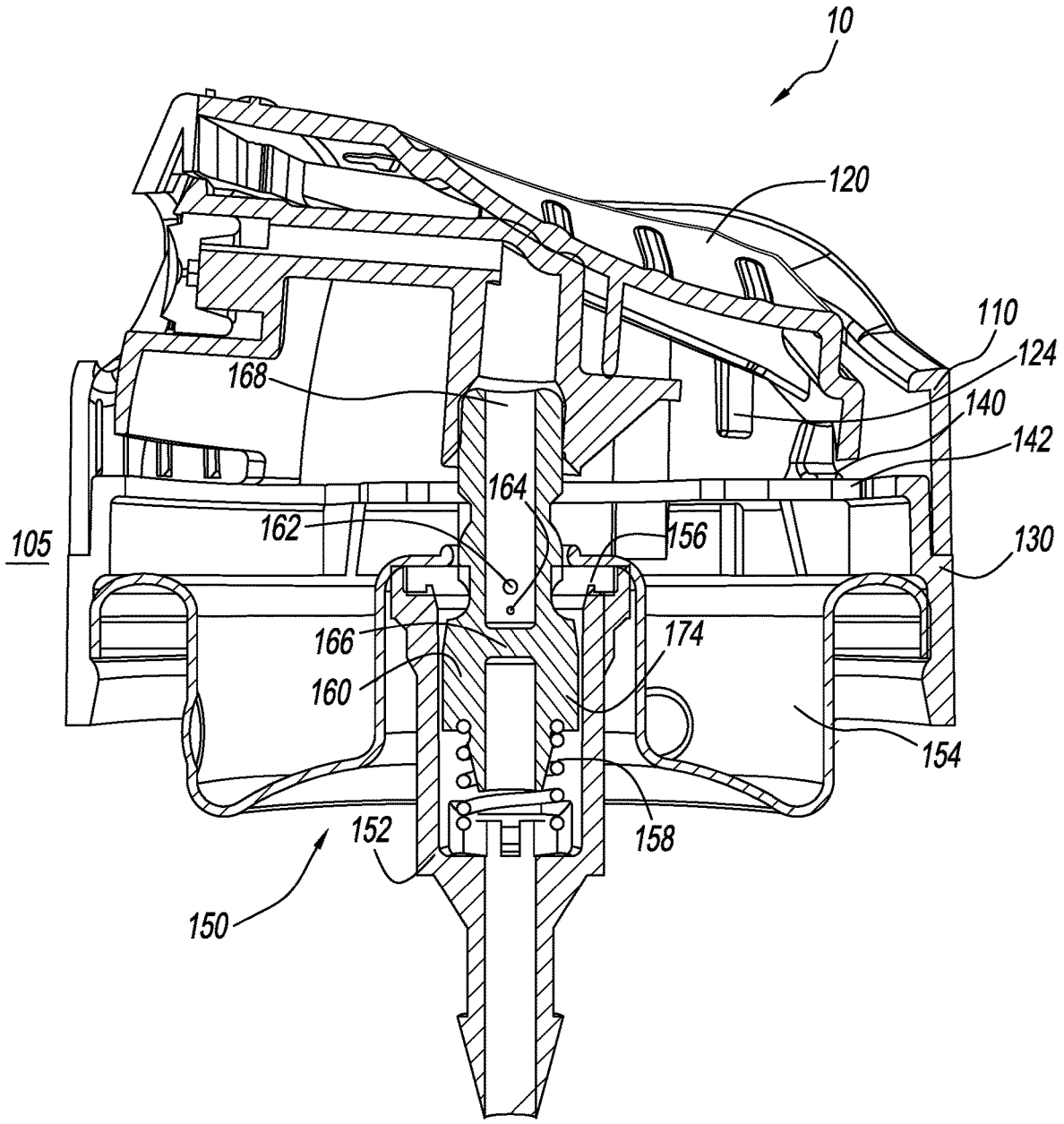
FIG. 5 is a cross sectional view of the dispensing system of FIG. 1 in the first actuating position.

Referring to FIGS. 4 and 5, overcap 110 has been rotated to position 103. Accordingly, finger 124 is above interference structure 142 and a partial stroke of actuator 100 has occurred to displace stem 160 with respect to sealing member 156. As stem 160 is displaced, orifice 164 is exposed, thereby enabling fluid 12 to flow therethrough for dispensing. Interference structure 142 prevents further stroke of actuator 100 and thus orifice 162 remains sealed.

Figure 6:
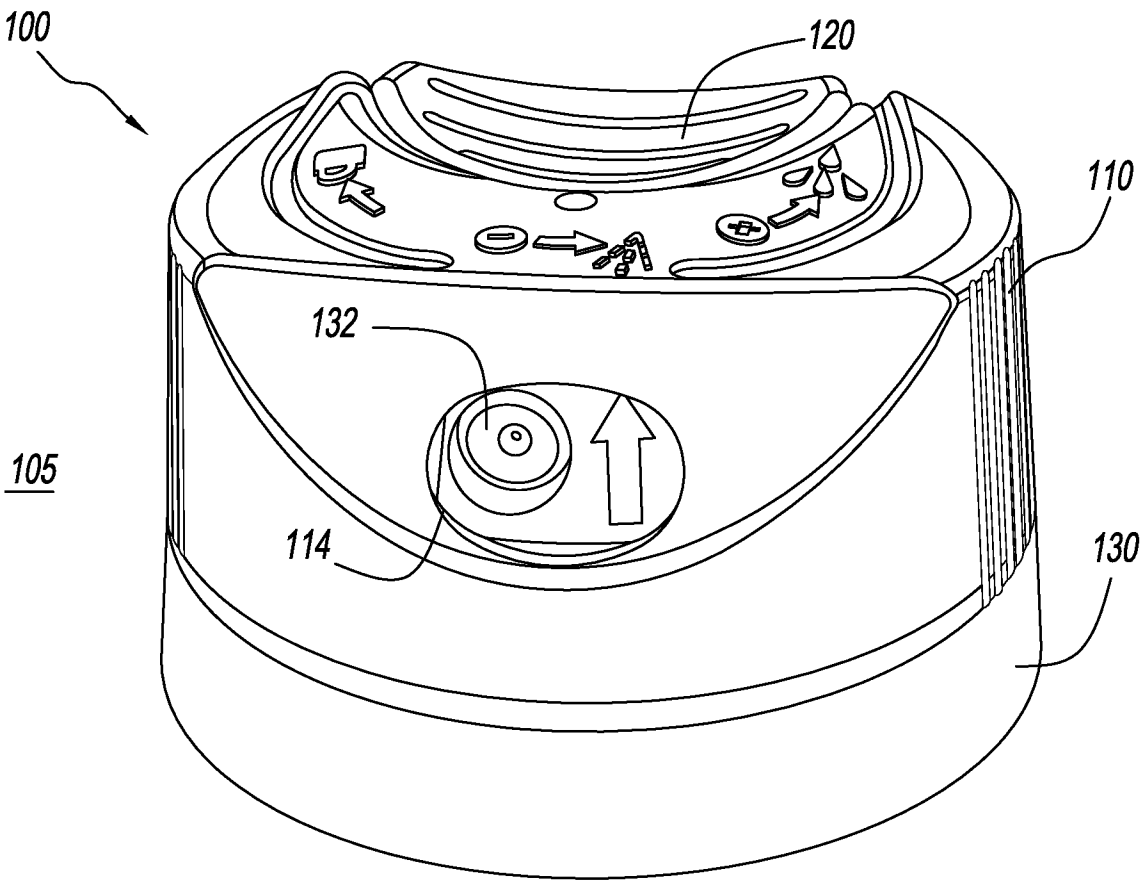
FIG. 6 is a perspective view of the actuator of FIG. 2 in a second actuating position.
Figure 7:
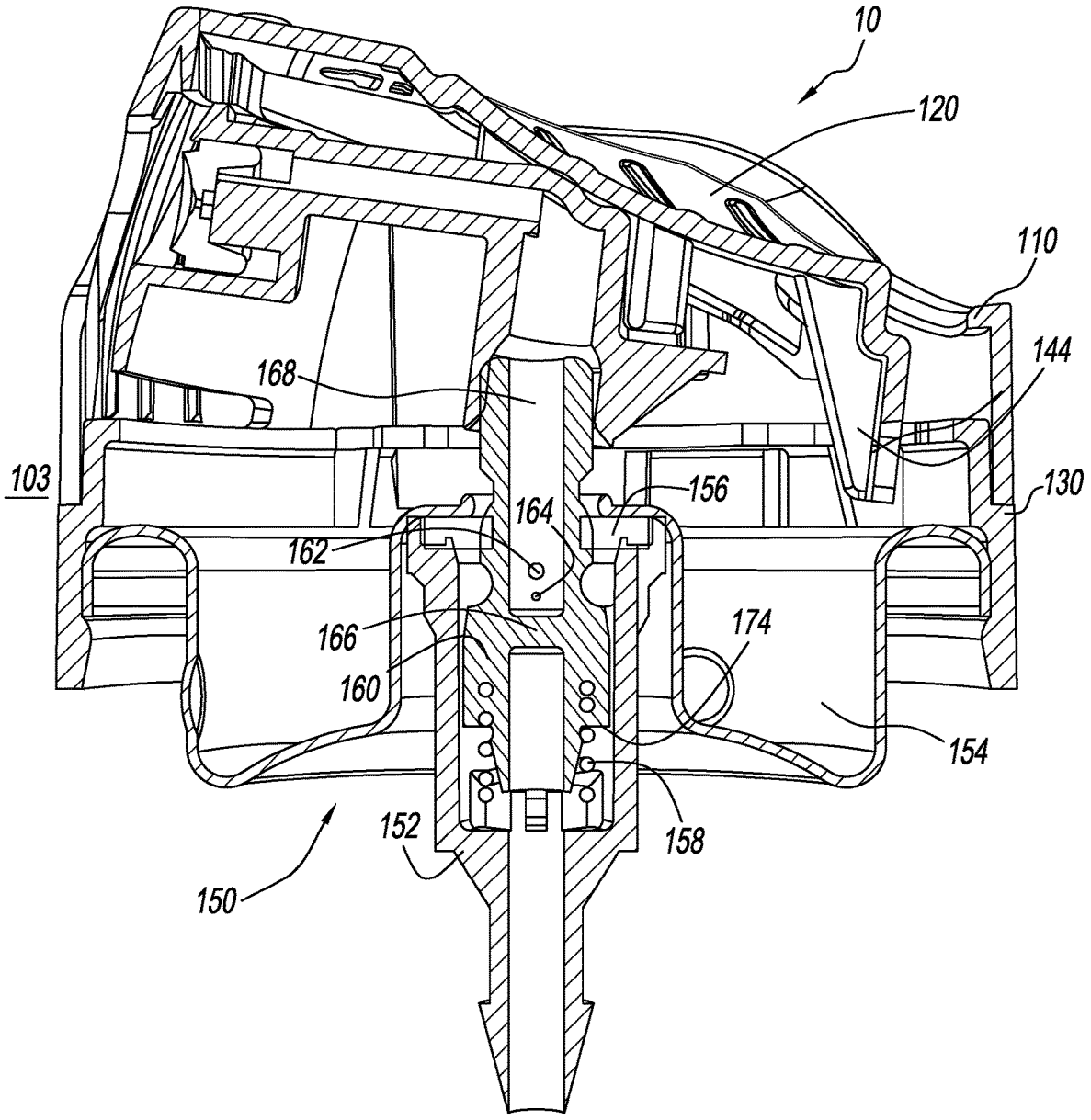
FIG. 7 is a cross sectional view also taken along line A-A of the dispensing system of FIG. 1 in the second actuating position.

Referring to FIGS. 6 and 7, overcap 110 has been rotated to position 105. Finger 124 is above area 144. Since there is no interference structure, a full stroke of actuator 100 is possible. Stem 160 can be further displaced with respect to sealing member 156 to expose orifice 162. Accordingly, both orifices 162 and 164 are exposed and fluid 12 can flow therethrough at a higher rate than position 103.

Figure 17:
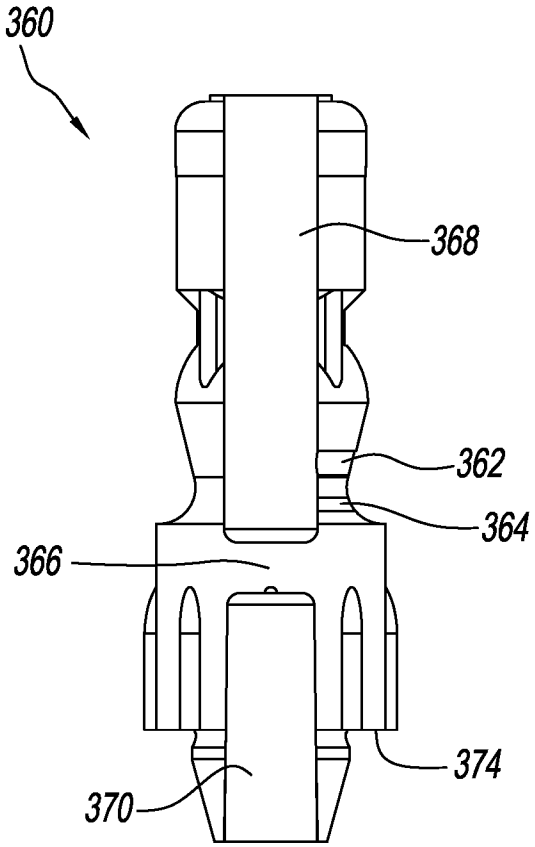
FIG. 17 is a cross sectional view the valve stem of FIG. 16 taken along lines C-C.
Figure 16:
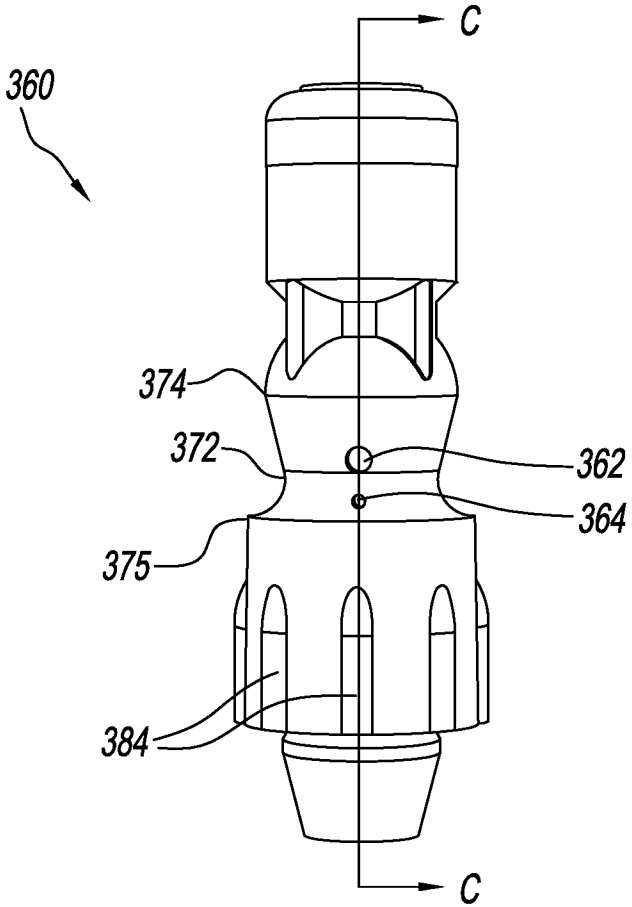
FIG. 16 is a side view of another exemplary valve stem of the present dispensing system.

Referring to FIGS. 16 and 17, another exemplary valve stem for use with the present dispensing system is shown, namely stem 360. Like stem 160, stem 360 has at least two vertically aligned lateral orifices, namely orifice 362 and orifice 364 that are selectively unsealed to enable a variable spray rate. Within stem 360 is an inner partition 366 that divides an upper passage 368 and a lower passage 370.

Externally stem 360 has an annular groove or neck 372 positioned at a point on the stem higher than partition 366. Neck 372 is defined by edge 375 at a lower portion of stem 360 and a rounded vertex 374 at an upper portion of the stem. Advantageously, rounded vertex 374 allows the sealing member 156 to freely move about the stem yet without the need for additional or extra travel distance. This geometry further reduces opportunities for stress cracks in sealing member 156. It should be noted that while stress cracks are of little to no concern in single function valves, in valves such as those of the present disclosure, these stress cracks can lead to valve failure.

Orifice 362 and orifice 364 are radially disposed in neck 372 to communicate with the interior of stem 360 providing fluid communication with upper passage 368. In certain embodiments, orifice 362 and orifice 264 are vertically displaced with respect to each other, and not vertically aligned. A shoulder surface 374 of stem 360 is located at a lower portion thereof and provides a surface against which biasing member 158 can engage.

Stem 360 also has a plurality of features 384, equally spaced around the stem. Features 384, for example formations, projections, and indentations, can provide flow channels for fluid. Features 384 can also form a gap between the stem body and housing wall. In a less preferred embodiment, it should be readily apparent that features 384 can, instead be, for example, ribs 176.

Figure 20:
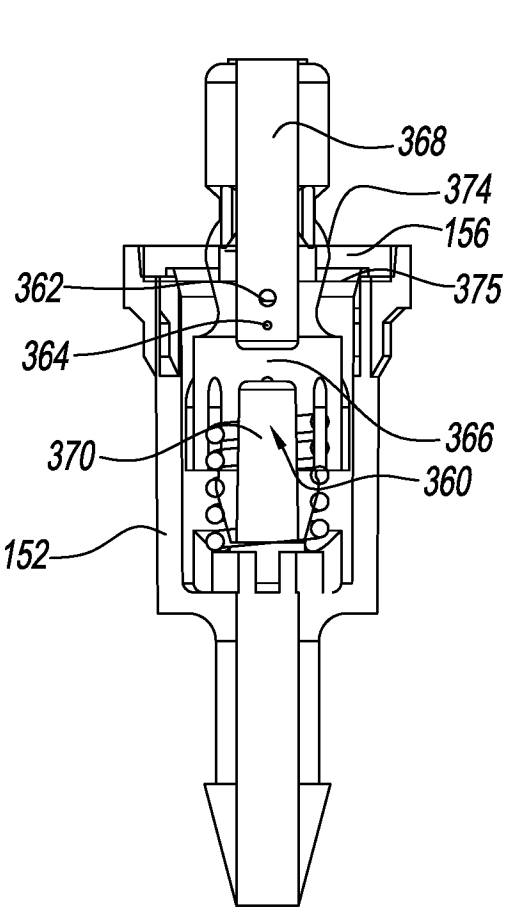
FIG. 20 is a cross sectional view of a valve with the valve stem of FIG. 16 shown in a non-actuating position.
Figure 19:
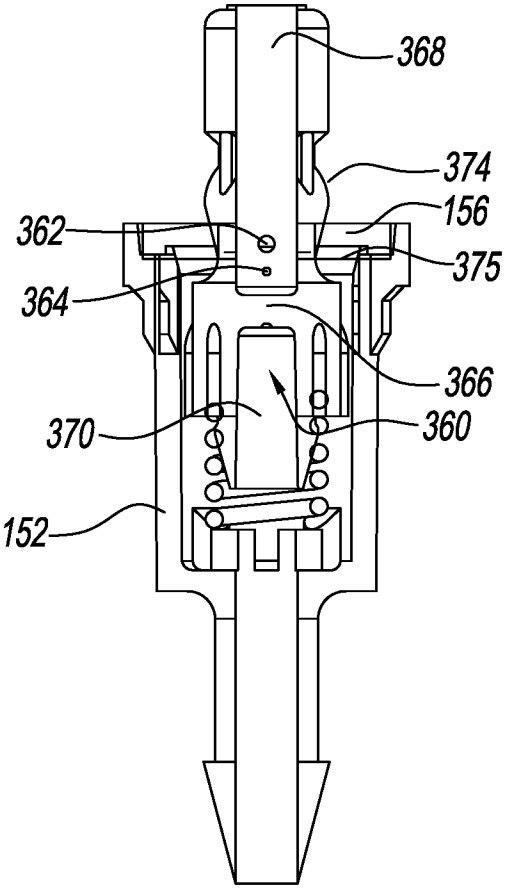
FIG. 19 is a cross sectional view of a valve with the valve stem of FIG. 16 shown in a non-actuating position.
Figure 18:
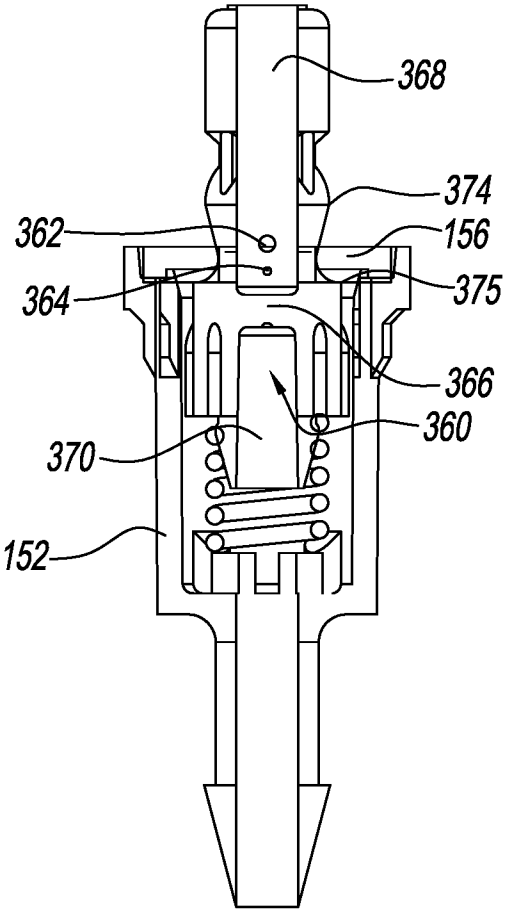
FIG. 18 is a cross sectional view of a valve with the valve stem of FIG. 16 shown in a non-actuating position.

Referring now to FIGS. 18 to 20, valve 350 is shown in positions 101, 103, and 105, respectively. Stem 360 is shown disposed in housing 152. Just like stem 160, stem 360 is disposed so that an upper portion projects through a central opening in a pedestal portion of cup 154. Cup 154 is crimped to a top of housing 152. Beneath an underside of cup 154 is sealing member 156. Sealing member 156 encircles orifice 362 and orifice 364 and acts to seal the orifices in position 101. Biasing member 158 is disposed in housing 152 between a base of the housing and stem 160 so that the stem is displaceable relative to sealing member 156. Thus, stem 360 is vertically displaceable in housing 152 to selectively uncover orifice 162 in position 103 to achieve a mass flow rate less than a nominal mass flow rate of system 10, or orifices 162 and 164 in position 105 to achieve a mass flow rate that is greater than the mass flow rate of position 103, namely a full stroke, thus enabling a variable or variation in spray rate in the two positions 103 and 105. Again, sealing member 156 covers both orifices 362 and 364 in position 101 which is the inoperative position or non-actuated position in which system 10 is locked and dispensing is prevented.

Housing 152 can be used with either stem 160 or stem 360 to create valve 150 or valve 350. Both valves are operable in conjunction with actuator 100 to control the spray rate.

As an embodiment of the present disclosure, the diameter of each orifice 164, 364 is about 0.25 mm, and the diameter of each orifice 162, 362 is about 0.46 mm. As an embodiment of the present disclosure, the distance between orifice 162 and orifice 164, and thus orifice 362 and orifice 364, is about 0.035 inch (0.89 mm). With these dimensions, a mass flow rate for position 103 is in the range of about 0.3 to about 0.5 grams per second. A mass flow rate for position 105 is in the range of about 0.9 to about 1.1 grams per second. Particularly, dispensing system 10 can achieve a mass flow rate having an average of about 0.41 grams per second in position 103, and about 0.98 grams per second in position 105.

The above-mentioned embodiment is one example of dispensing system 10. As understood by one of ordinary skill in the art, the present disclosure can have other embodiments of dispensing system 10 that require different orifice sizes, shapes, spaces and number of orifices. Dispensing system 10 preferably has the ability to prevent leakage, the ability to separate between the spray-less and spray-more function in mass flow rate, and the ability to match the customer's requested mass flow rates with their particular product. Accordingly, there is no limitation to the shape of the orifice, the number of the orifice, the location of the orifice, or the distance between the orifices, as long these desirable features can be met.

In the present disclosure, the spray-less position operation releases a less amount of spray fluid than that of spray-more position operation. No setting is required, other than turning overcap 110. The spray-more position distributes a normal or full amount of fluid spray. This spray-more position releases the same amount as any normal actuator and delivers a noticeable larger amount of spray than the spray-less position.

According to dispensing system 10 of the present disclosure, a user simply rotates overcap 110 to switch from among positions 101, 103 and 105 and presses the sole button 120 to commence dispensing.

The spray-less position is controllable in accordance with a manufacturer's requirements. The mass flow rate of the spray-less position (analogous to position 103) can be as little as 80% reduction relative to the spray-more position (analogous to position 105). The variability of the two different mass flow rates of the spray-less position and the spray-more position can be infinite since determined by the viscosity of the product and the pressure of aerosol in container 50.

When the same reference number is used in different figures of the drawings, the reference number refers to the same or like part. When a certain structural element is described as "is connected to", "is coupled to", or "is in contact with" a second structural element, it should be interpreted that the second structural element can "be connected to", "be coupled to", or "be in contact with" another structural element, as well as that the certain structural element is directly connected to or is in direct contact with yet another structural element.

It should be noted that the terms "first", "second", and the like can be used herein to modify various elements. These modifiers do not imply a spatial, sequential or hierarchical order to the modified elements unless specifically stated.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness can in some cases depend on the specific context. However, generally speaking, the nearness of completion will be to have the same overall result as if absolute and total completion were obtained.

As used herein, the term "about" is used to provide flexibility to a numerical range endpoint by providing that a given value may be "a little above" or "a little below" the endpoint. Further, where a numerical range is provided, the range is intended to include any and all numbers within the numerical range, including the end points of the range.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiment(s) disclosed as the best mode contemplated, but that the disclosure will include all embodiments falling within the scope of the appended claims.

The invention claimed is:

1. A method for selectively spraying fluid at different mass flow rates from a container, the method comprising:

causing a finger that is radially offset from a longitudinal axis of the container to revolve about the longitudinal axis by rotating an overcap of an actuator on a base to select from between a first mass flow rate position and a second mass flow rate position, wherein the overcap is connected by a living hinge to a button that has a finger extending downwardly therefrom;

pivoting the button about the living hinge to cause displacement of a stem of a valve of the container, wherein the stem has a first orifice and a second orifice, and wherein the first orifice and the second orifice are covered by a monolithic gasket in a non-actuated valve position; and wherein displacement of the stem by a first distance relative to the gasket when the overcap is in the first mass flow rate position unseats the gasket to uncover the second orifice while the first orifice remains covered only by the gasket so that fluid sprays at a first mass flow rate; and wherein displacement of the stem by a second distance that is greater than the first distance relative to the gasket when the overcap is in the second mass flow rate position unseats the gasket to uncover the first orifice and the second orifice to so that fluid sprays at a second mass flow rate that is higher than the first mass flow rate.

2. The method according to claim 1, wherein the base comprises an interference structure, and wherein the finger is positioned over the interference structure when the actuator is in the first mass flow rate position to prevent the stem from being moveable the second distance when the button is pressed.

3. The method according to claim 1, wherein the overcap is rotated on the base to select from among, aa locked position, the first mass flow rate position, and the second mass flow rate position.

4. The method according to claim 3, wherein the base comprises an interference structure, and wherein the finger is positioned over the interference structure when the actuator is in the locked position to prevent the stem from being moveable the first distance, thereby preventing actuation.

5. The method according to claim 3, wherein the base comprises a first interference structure and a second interference structure, wherein the finger is positioned over the first interference structure when the actuator is in the locked position to prevent the stem from being moveable the first distance, thereby preventing actuation, and wherein the finger is positioned over the second interference structure when the actuator is in the first mass flow rate position to prevent the stem from being moveable the second distance when the button is pressed.

6. The method according to claim 1, wherein the gasket is impermeable to spray fluid and seals the stem.

7. The method according to claim 1, wherein the first orifice is vertically aligned with the second orifice.

8. The method according to claim 1, wherein the first orifice has a diameter that is larger than a diameter of the second orifice.

* * * * *